United States Patent [19]

Mackle

[11] Patent Number: 4,616,865

[45] Date of Patent: Oct. 14, 1986

[54] SECURITY LOCK ASSEMBLY

[75] Inventor: Michael T. Mackle, St. Ives, Australia

[73] Assignee: Wormald International, Limited, New South Wales, Australia

[21] Appl. No.: 645,049

[22] Filed: Aug. 28, 1984

[51] Int. Cl.[4] ..... E05C 13/10

[52] U.S. Cl. ..... 292/341.16

[58] Field of Search ..... 292/144, 150, 201, 341.15, 292/341.16, 341.17; 70/416, 418

[56] References Cited

U.S. PATENT DOCUMENTS

| | | | |
|---|---|---|---|
| 1,954,135 | 4/1934 | Kelly et al. . | |
| 2,425,262 | 8/1947 | Newton | 70/1.5 |
| 2,767,011 | 10/1956 | Buckley | 292/341.16 |
| 2,786,701 | 3/1957 | Povlich | 292/341.16 X |
| 3,751,088 | 8/1973 | Schlage et al. | 292/201 |
| 3,919,869 | 11/1975 | Fromm | 292/341.16 |
| 4,180,996 | 1/1980 | Lebrecht | 70/417 X |

FOREIGN PATENT DOCUMENTS

| | | |
|---|---|---|
| 21696 | 10/1970 | Australia . |
| 21296 | 10/1970 | Australia . |
| 24331 | 1/1971 | Australia . |
| 70972 | 5/1981 | Australia . |
| 386544 | 12/1923 | Fed. Rep. of Germany . |
| 433321 | 9/1926 | Fed. Rep. of Germany . |
| 227616 | 1/1925 | United Kingdom . |
| 907523 | 10/1961 | United Kingdom . |
| 1376708 | 12/1974 | United Kingdom . |
| 1515531 | 6/1978 | United Kingdom . |

*Primary Examiner*—Richard E. Moore

*Attorney, Agent, or Firm*—Knobbe, Martens, Olson & Bear

[57] ABSTRACT

Security lock assembly includes a movable lock bolt adapted for mounting to a door, and a striker unit adapted for mounting to a door jamb, which unit defines a bolt cavity. Latch means is mounted for movement to an operative position protruding into the cavity in which the latch means is engagable with the bolt to prevent its withdrawal from the cavity. Drive means drives the latch means to its operative position. A magnetized element in the bolt causes a magnetically operable switch mounted on the striker unit adjacent the bolt cavity to activate the drive means on the receipt of the lock bolt in the cavity.

10 Claims, 6 Drawing Figures

SECURITY LOCK ASSEMBLY

This invention relates to security lock assemblies especially suitable for doors.

The invention provides novel security lock assembly comprising: a movable lock bolt, a striker unit adapted for mounting on a door jamb, which unit defines a cavity to receive a lock bolt, latch means mounted on said striker unit for movement to an operative position protruding into said cavity in which the latch means is engagable with the bolt to prevent its withdrawal from the cavity, means to drive the latch means to said operative position, a magnetized element in said lock bolt, and a magnetically operable switch mounted so said striker unit adjacent the bolt cavity, which switch is responsive to said magnetized element, on receipt of the lock bolt in said cavity, to activate said drive means.

The magnetically operable switch on said striker unit adjacent the bolt cavity may, for example, comprise a reed switch, advantageously encased in a solid medium behind an inner bounding wall for the bolt cavity. The reed would typically then be movable in a small elongate hollow in the medium. For operating the switch, the bolt is provided with a magnetized element, preferably encased in a spherical or cylindrical core within the bolt. The core may be rotatably disposed within the bolt to thwart cutting through of the bolt and/or removal of the magnetized element.

Said structure may comprise a metal striker plate with a rectangular bolt cavity to receive the lock bolt of a deadbolt mechanism. The movable latch means engagable with the bolt may be a pin, rod or the like, e.g., a cylindrical rod, adapted to engage in a hole in the bolt and preferably arranged so that it tends to fall from the bolt cavity under gravity unless held in its operative position. A suitable helical spring may be provided to augment the gravity bias on the rod.

The drive means preferably includes a solenoid which is energizable, preferably in response to receipt of lock bolt in the cavity, to drive the latch means, directly or indirectly, into locking engagement with the bolt and to retain it in such locking engagement.

Further switches are advantageously provided for indicating to a remote control panel whether the bolt is in the cavity and whether the latch means is in its operative position.

The invention will be further described, by way of example only, with reference to the accompanying drawings, in which.

Figure 1:
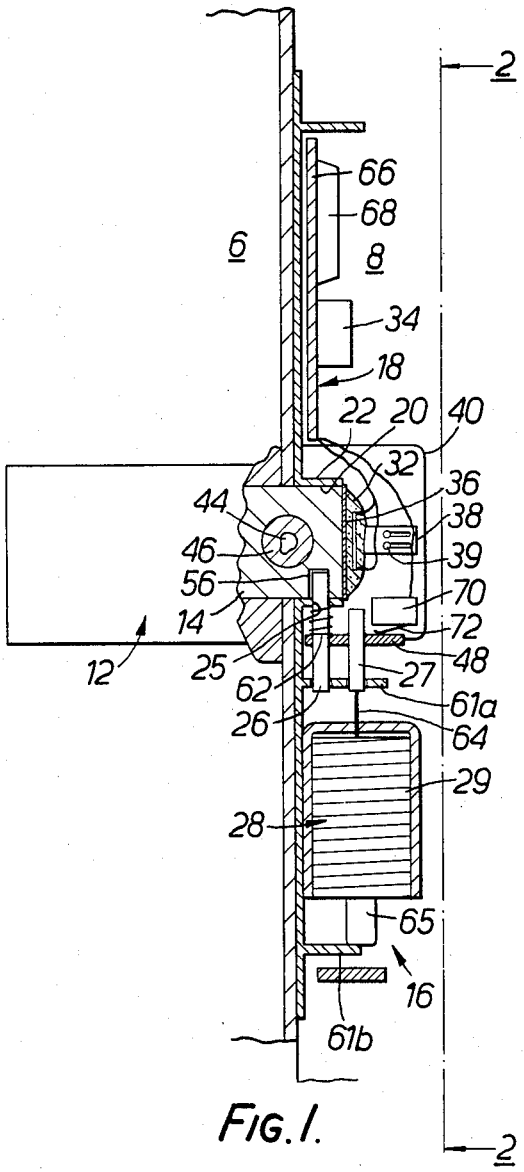
FIG. 1 is a vertical cross-section through a closed door fitted with a security lock assembly in accordance with the invention.
Figure 2:
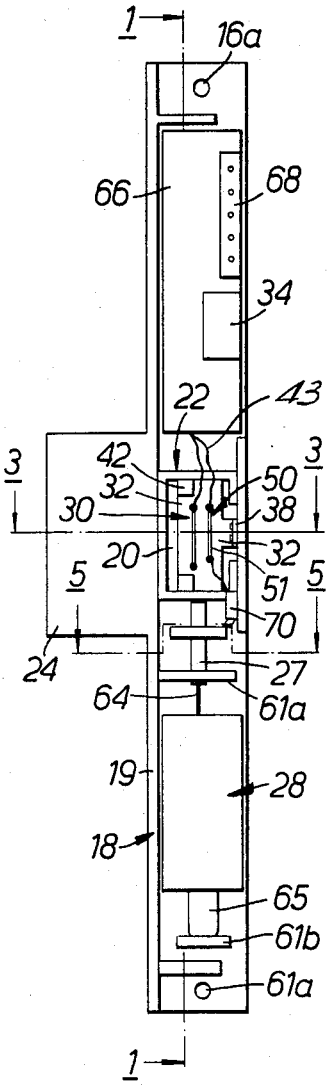
FIG. 2 is a rear elevational view of the striker assembly of the security lock assembly.
Figure 3:
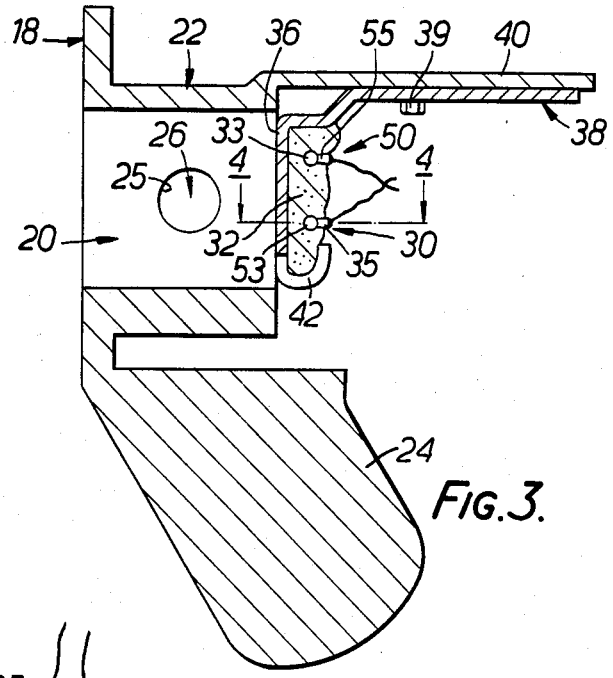
Figure 4:
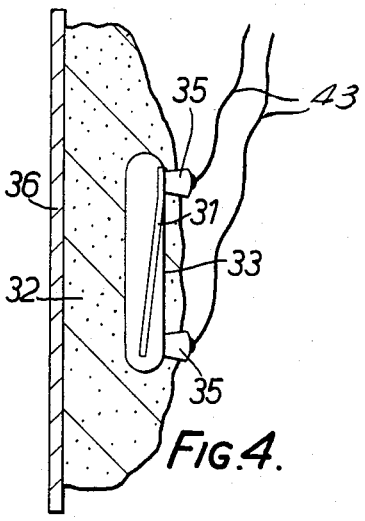
Figure 5:
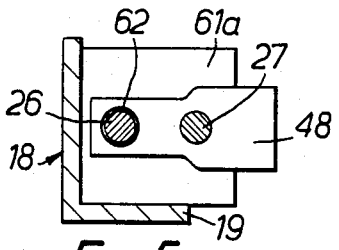
Figure 6:
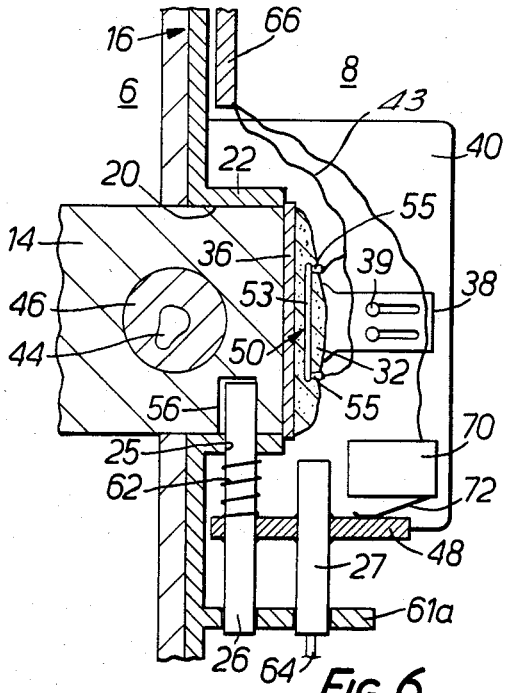

FIGS. 3 and 4 are cross-sections on the lines 3—3 and 4—4 in FIGS. 2 and 3 respectively;

FIG. 5 is a cross-section on the line 5—5 in FIG. 2, but with the locking pin shown retracted; and FIG. 6 is an enlargement of the central area of FIG. 1.

The illustrated security lock assembly, fitted to a door leaf 6 and door jamb 8, includes a deadbolt latch mechanism 12, having a rectangular bolt 14, in leaf 6, and a striker assembly 16 defining a striker plate 18 and bolt cavity 20, manufactured as a single unit adapted for mounting in the jamb 8. Screw holes 16*a* are provided for this purpose.

Deadbolt latch mechanism 12 is of a conventional construction apart from the bolt 14 and, except for this aspect which will be detailed hereinafter, will not be further described.

Striker plate 18 is of L-section steel. Bolt cavity 20 is defined by a box protrusion 22 cast integrally with the striker plate. The narrower flange 19 of plate 18 carries the usual bolt lead ramp 24 adjacent cavity 20.

The bolt locking apparatus is mounted behind the striker plate 18. The principal components of the apparatus include latch means comprising a slidable bolt locking pin 26, a drive solenoid 28 for the pin, a pair of reed switches 30, 50 encased in a solid resin medium 32 at the rear of bolt cavity 20, and a switching relay 34 operated by reed switch 30 for setting the state of the solenoid and thereby the position of pin 26. Reed switch 30, relay 34 and solenoid 28 together constitute means responsive to receipt of the bolt in the cavity to drive pin 26 to an operative position in the cavity in engagement with the bolt 14 to prevent withdrawal of the bolt from the cavity. For enhanced clarity, electrical wiring connections are not fully detailed in the drawings, although the leads for reed switches 30, 50 are depicted at 43.

With reference in particular to FIG. 4, reed switches 30, 50 comprise respective reeds 31, 51 in elongate hollows 33, 53 extending between contact sets 35, 55 cast in medium 32. Medium 32 is fixed behind a back plate 36 for cavity 20 provided by a bracket 38 (FIG. 3). Bracket 38 is adjustably mounted by small bolts 39 to a plate 40 projecting integrally from striker plate 18 adjacent cavity 20. Medium 32 is adhered to bracket 38 and is further retained by return lugs 42 at the top and bottom of plate 36.

Reeds 31, 51 are of a magnetically sensitive metal and are operated, to open the contacts 35, 55, by a magnetized slug 44 (FIGS. 1 and 6) in bolt 14. Slug 44 is encased in a spherical core 46, which is in turn freely rotatable with all degrees of freedom, in a complementary cavity in the bolt so that any cutting implement applied to the bolt will in due course strike the sphere and indefinitely rotate it rather than cut it through. The core 46 thus thwarts both cutting of the bolt and removal of the magnetized slug.

Pin 26 is one of a pair 26, 27 fixedly coupled by a horizontal plate 48. The pins are firmly but freely slidable through respective apertures in a rearwardly projecting flange 61*a* behind striker plate 18. Pin 26 projects through a matchine aperture 25 in box 22 and is slidable upwardly to an operative position in which it firmly engages in a complementary hole 56 in the underside of bolt 14. When not held in this operative position, the assembly of pins 26, 27 and plate 48 tends to fall under gravity to withdraw pin 26 from cavity 20. A helical compression spring 62 about pin 26 between box 22 and plate 48 augments the gravity bias.

The lower end of pin 27, which is of course shorter than pin 26, abuts a magnetically sensitive rod 64 which is surrounded by the coil 29 of solenoid 28. When the solenoid is not energized, the enlarged bottom 65 of rod 64 rests on a lower flange 61*b* behind striker plate 18.

The space above cavity 20 is occupied by a small circuit board 66 with multi-point connector 68 and the aforementioned relay 34. As already foreshadowed, the contact set 35 of reed switch 30 is connected for operating relay 34. The contact set 55 of reed switch 50 is coupled via connector 68 to a remote central monitoring control, not shown, at which the state of the reed switch would be indicated in any suitable manner, such as by a light.

A third reed switch 70 is mounted to plate 40 under bracket 38 but is mechanically rather than magnetically operated. The external reed 72 of this switch is engaged by plate 48 as it nears the top of its upward travel and reed switch 70 may thus be employed to indicate at the remote control that pin 26 is in an operative, bolt engaging position.

The operation of the security lock assembly will now be reviewed. When the door leaf 6 is shut and the bolt 14 thrown, the receipt of the bolt into cavity 20 is sensed by both reed switches 30, 50 in that the magnetized slug 44 changes the state of the switches. Switch 30 thereby triggers relay 34 to energize solenoid 28. Rod 64 is propelled upwardly against pin 27 and the pin 26 thereby driven against gravity and spring 62 into the hole 56. Bolt 14 is thereby positively and physically locked into the striker cavity. Switch 50 will have transmitted a signal to the control monitor to indicate that the bolt has entered the striker cavity 20, while plate 48 will have operated switch 70 to transmit a further signal confirming that pin 26 is in its operative position. This action will have taken place entirely automatically and thus any person who has passed through into a security area and shut the door will be trapped in the security area and will only be able to depart on the withdrawal of the power supply to the solenoid by appropriate switching at the central control. Moreover, consequent unlocking and withdrawal of the bolt are separately monitored by switches 70 and 50.

It will be noted that the security provisions do not prevent opening the door in an emergency. In the event of a fire or other emergency in an installation with multiple doorways fitted out as illustrated, the power may be simultaneously withdrawn from the solenoids of all doorways to permit the withdrawal of the respective bolts from their striker cavities.

I claim:

1. A security lock assembly comprising:

a movable lock bolt;

a striker unit which is adapted for mounting in a door jamb and which defines a cavity to receive said lock bolt;

latch means mounted on said striker unit for movement to an operative position protruding into said cavity in which said latch means is engageable with said bolt therein to prevent its withdrawal from said cavity;

drive means to drive said latch means to said operative position;

a magnetized element in said lock bolt;

a magnetically operable switch mounted on said striker unit adjacent said bolt cavity, which switch is located near said element so as to be responsive to said magnetized element, on receipt of said lock bolt in said cavity; and circuit means between said drive means and said switch to activate said drive means upon operation of said switch.

2. A security lock assembly according to claim 1 wherein said switch is encased in a solid medium behind an inner bounding wall of the bolt cavity.

3. A security lock assembly according to claim 1 wherein said movable latch means engageable with said bolt is a pin, rod or the like adapted to engage in a hole in said bolt.

4. A security lock assembly according to claim 1 wherein said latch means is so arranged that it tends to fall from said bolt cavity under gravity unless held in its operative position.

5. A security lock assembly according to claim 4 further comprising a helical spring on said striker unit to augment the gravity bias on said latch means.

6. A security lock assembly according to claim 1 wherein said drive means includes a solenoid which is energizable to drive said latch means into locking engagement with said bolt and to retain it in such locking engagement.

7. A security lock assembly according to claim 1 further comprising one or more further switches on said striker unit for indicating to a remote control panel whether said bolt is in said cavity and/or whether said latch means is in its operative position.

8. A security lock assembly according to claim 1 wherein said magnetized element is encased in a core which is rotatably disposed within said bolt to thwart cutting through of said bolt and/or removal of said magnetized element.

9. A security lock assembly according to claim 8 wherein said movable latch means engageable with said bolt is a pin, rod or the like adapted to engage in a hole in the bolt.

10. A security lock assembly according to claim 8 wherein said core is a spherical core.

* * * * *